US010697673B2

(12) United States Patent
Numasawa et al.

(10) Patent No.: US 10,697,673 B2
(45) Date of Patent: Jun. 30, 2020

(54) CONDENSER WITH LIQUID RECEIVER

(71) Applicant: KEIHIN THERMAL TECHNOLOGY CORPORATION, Oyama-shi (JP)

(72) Inventors: Makoto Numasawa, Oyama (JP); Naohisa Higashiyama, Oyama (JP); Hideo Ohashi, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 79 days.

(21) Appl. No.: 16/048,347

(22) Filed: Jul. 30, 2018

(65) Prior Publication Data

US 2019/0063802 A1 Feb. 28, 2019

(30) Foreign Application Priority Data

Aug. 28, 2017 (JP) ..... 2017-163002

(51) Int. Cl.
*F25B 40/02* (2006.01)
*F25B 39/04* (2006.01)
(Continued)

(52) U.S. Cl.
CPC ..... *F25B 39/04* (2013.01); *F25B 40/02* (2013.01); *F28D 1/05391* (2013.01);
(Continued)

(58) Field of Classification Search
CPC ..... F25B 39/04; F25B 2339/0441; F25B 2339/0446; F25B 2339/044; F25B 2339/0445; F25B 40/02; F28F 1/126; F28F 9/026; F28F 9/028; F28F 9/0265; F28F 27/02; F28F 9/02; F28F 2220/00;
(Continued)

(56) References Cited

U.S. PATENT DOCUMENTS 6,694,773 B1 * 2/2004 Snow ..... F25B 39/04 62/474
7,043,936 B2 * 5/2006 Jung ..... F25B 39/04 62/474
(Continued)

FOREIGN PATENT DOCUMENTS

JP 2010-185648 8/2010

*Primary Examiner* — Frantz F Jules
*Assistant Examiner* — Lionel Nouketcha
(74) *Attorney, Agent, or Firm* — Mori & Ward, LLP

(57) ABSTRACT

A liquid receiver of a condenser has a liquid receiver main body and a plug removably fitted thereinto. The liquid receiver main body has a refrigerant inflow hole into which refrigerant flows from a condensation section and a refrigerant outflow hole from which refrigerant flows into a supercooling section. The liquid receiver has a first space formed above the upper end of the plug and communicating with the refrigerant inflow hole and a second space formed below the upper end of the plug and communicating with the refrigerant outflow hole. The plug has a flow passage which is open to the first space and the second space at opposite ends. The first-space-side opening of the flow passage is located below the refrigerant inflow hole. The flow passage has a throttle portion whose cross-sectional area is smaller than a hole area of the refrigerant inflow hole.

5 Claims, 8 Drawing Sheets

(51) Int. Cl.

| | |
|---|---|
| ***F28D 1/053*** | (2006.01) |
| ***F28F 9/02*** | (2006.01) |
| *F28D 21/00* | (2006.01) |
| *F28F 1/12* | (2006.01) |
| *F28F 27/02* | (2006.01) |

(52) U.S. Cl.
CPC ..... *F28F 9/0209* (2013.01); *F28F 9/0243* (2013.01); *F25B 2339/0441* (2013.01); *F25B 2339/0445* (2013.01); *F25B 2339/0446* (2013.01); *F25B 2400/16* (2013.01); *F25B 2400/162* (2013.01); *F25B 2400/23* (2013.01); *F28D 1/05341* (2013.01); *F28D 1/05366* (2013.01); *F28D 2021/0084* (2013.01); *F28D 2021/0091* (2013.01); *F28F 1/126* (2013.01); *F28F 9/02* (2013.01); *F28F 9/026* (2013.01); *F28F 9/028* (2013.01); *F28F 9/0265* (2013.01); *F28F 27/02* (2013.01); *F28F 2220/00* (2013.01); *F28F 2230/00* (2013.01)

(58) Field of Classification Search
CPC ..... F28F 2230/00; F28D 1/05341; F28D 1/05366; F28D 1/05391; F28D 2021/0091; F28D 2021/0084
See application file for complete search history.

(56) References Cited

U.S. PATENT DOCUMENTS

| | | | | |
|---|---|---|---|---|
| 7,350,375 | B2 * | 4/2008 | Knecht | F25B 43/003 62/474 |
| 8,950,213 | B2 * | 2/2015 | Mitsuhashi | F25B 39/04 165/110 |
| 9,377,228 | B2 * | 6/2016 | Lee | F25B 43/00 |
| 2008/0006052 | A1 * | 1/2008 | Ki | F25B 43/006 62/474 |
| 2008/0314252 | A1 * | 12/2008 | Min | F25B 39/04 96/151 |
| 2011/0247792 | A1 * | 10/2011 | Chikuma | B23K 1/0012 165/173 |
| 2012/0210745 | A1 * | 8/2012 | Ikeda | C09K 5/045 62/474 |

* cited by examiner

CONDENSER WITH LIQUID RECEIVER

BACKGROUND OF THE INVENTION

The present invention relates to a condenser used in a car air conditioner which is a refrigeration cycle mounted on, for example, an automobile.

Herein and appended claims, the upper side and lower side of FIG. 1 will be referred to as "upper" and "lower," respectively.

Herein, the term "liquid-phase refrigerant" encompasses liquid-phase predominant mixed-phase refrigerant containing a small amount of gas-phase refrigerant.

The applicant of the present invention has proposed a condenser for a car air conditioner (see Japanese Patent Application Laid-Open (kokai) No. 2010-185648). The proposed condenser includes a condensation section, a supercooling section provided below the condensation section, and a liquid receiver which is provided between the condensation section and the supercooling section and which receives gas-liquid-mixed-phase refrigerant from the condensation section and separates the gas-liquid-mixed-phase refrigerant into gas-phase refrigerant and liquid-phase refrigerant. The condensation section includes a condensation section outlet header whose longitudinal direction coincides with a vertical direction, and a plurality of heat exchange tubes each of which is connected, at one end in the longitudinal direction, to the condensation section outlet header. The supercooling section includes a supercooling section inlet header disposed below the condensation section outlet header such that its longitudinal direction coincides with the vertical direction, and a plurality of heat exchange tubes each of which is connected, at one end in the longitudinal direction, to the supercooling section inlet header. The liquid receiver is composed of a tubular base member having an open upper end and a closed lower end, and a cylindrical tubular liquid receiver main body which has a closed upper end and an open lower end and which is screwed into the base member. A refrigerant inflow hole into which refrigerant flows from the condensation section outlet header of the condensation section and a refrigerant outflow hole from which refrigerant flows into the supercooling section inlet header of the supercooling section are formed in the base member such that the refrigerant inflow hole is spaced from the refrigerant outflow hole in the vertical direction and is located above the refrigerant outflow hole. A plate-shaped partition member for dividing the interior of the liquid receiver into upper and lower compartments is provided in the base member at a vertical position between the refrigerant inflow hole and the refrigerant outflow hole. An overflow pipe is provided on the partition member which allows refrigerant to flow from the first compartment above the partition member to the second compartment below the partition member when the level of refrigerant within the first compartment reaches a predetermined level. The upper end of the overflow pipe is located at a vertical position above the refrigerant inflow hole, and the cross-sectional area of the flow passage of the overflow pipe is approximately the same as the hole area of the refrigerant inflow hole.

In the condenser disclosed in the publication, the gas-liquid-mixed-phase refrigerant having flowed from the condensation section outlet header into the first compartment within the liquid receiver through the refrigerant inflow hole is separated into gas-phase refrigerant and liquid-phase refrigerant within the first compartment. After a predetermined amount of liquid-phase refrigerant accumulates in the first compartment, the liquid-phase refrigerant flows into the second compartment through the overflow pipe. Therefore, the proposed condenser has an excellent gas liquid separation performance.

However, the condenser disclosed in the publication has the following problem. When refrigerant is charged into a refrigeration cycle in which the condenser is used, after a predetermined amount of liquid-phase refrigerant accumulates in the first compartment, the liquid-phase refrigerant flows into the heat exchange tubes of the supercooling section through the second compartment, the refrigerant outflow hole, and the supercooling section inlet header. Therefore, the heat exchange tubes of the supercooling section cannot be filled with liquid-phase refrigerant at an early stage, and a relatively large amount of refrigerant must be charged to reach a stable region where the degree of supercooling becomes constant. Accordingly, a relatively large amount of refrigerant must be charged.

SUMMARY OF THE INVENTION

In view of the above-described problem, an object of the present invention is to provide a condenser which can reduce the amount of refrigerant to be charged by reducing the amount of refrigerant which must be charged to reach a stable region where the degree of supercooling becomes constant.

A condenser according to the present invention comprises a condensation section; a supercooling section provided below the condensation section; and a liquid receiver which is provided between the condensation section and the supercooling section and which receives gas-liquid-mixed-phase refrigerant from the condensation section and separates the gas-liquid-mixed-phase refrigerant into gas-phase refrigerant and liquid-phase refrigerant. The liquid receiver includes a liquid receiver main body whose longitudinal direction coincides with a vertical direction and which has a closed upper end and an open lower end, and a plug removably fitted into the liquid receiver main body from below so as to close a lower end opening of the liquid receiver main body. The liquid receiver main body has a refrigerant inflow hole into which refrigerant flows from the condensation section and a refrigerant outflow hole from which refrigerant flows into the supercooling section. The refrigerant inflow hole and the refrigerant outflow hole are formed at an interval in the vertical direction such that the refrigerant inflow hole is located above the refrigerant outflow hole. The liquid receiver has a first space which is formed above an upper end of the plug and with which the refrigerant inflow hole communicates and a second space which is formed below the upper end of the plug and with which the refrigerant outflow hole communicates. The plug has a flow passage one end of which is open to the first space and the other end of which is open to the second space. An opening of the flow passage on the first space side is located at a vertical position below the refrigerant inflow hole. A throttle portion having a cross-sectional area smaller than a hole area of the refrigerant inflow hole is provided in the flow passage.

DESCRIPTION OF THE PREFERRED EMBODIMENT

Figure 1:
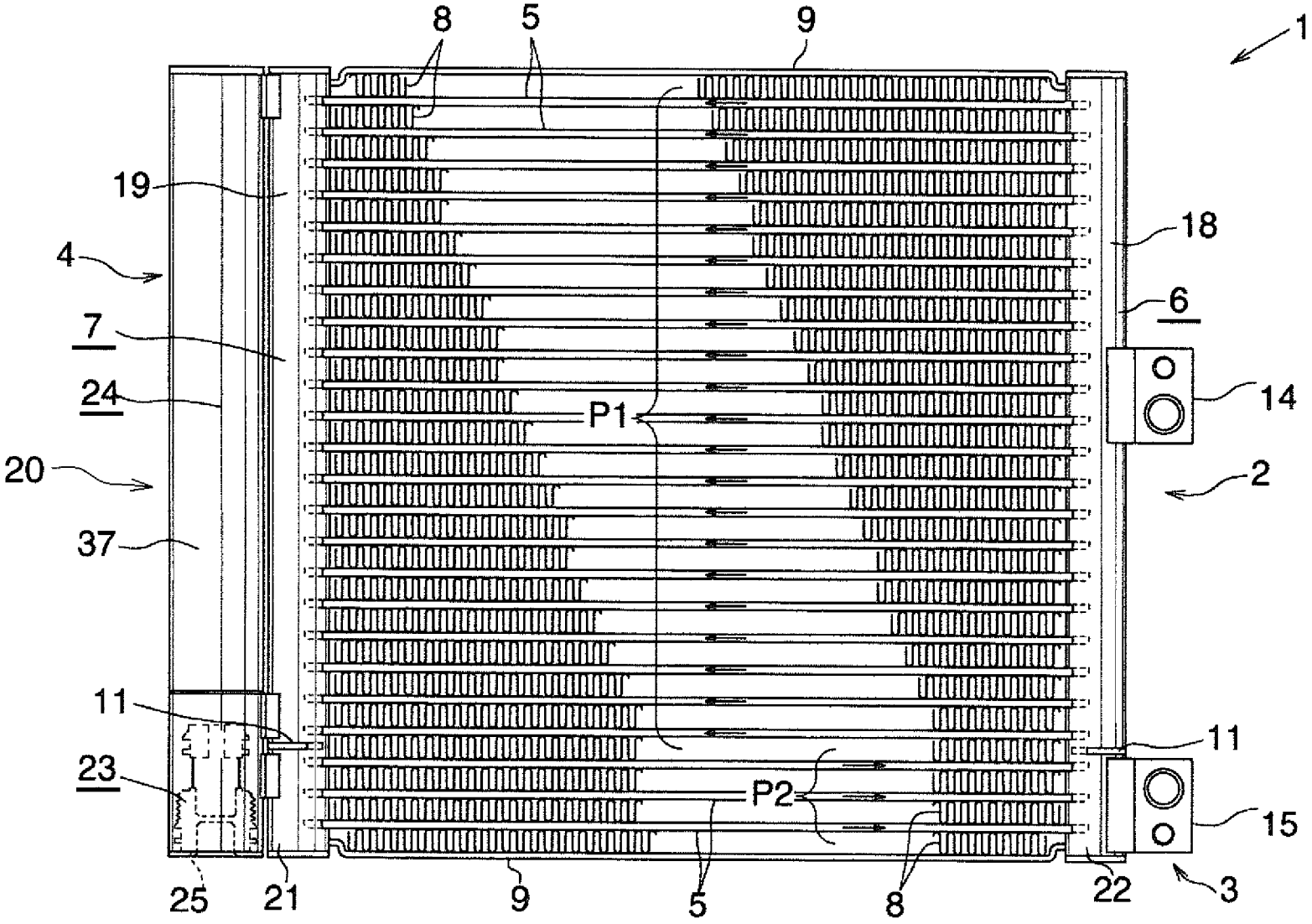
FIG. 1 is a front view specifically showing the overall structure of a condenser according to the present invention.

An embodiment of the present invention will next be described with reference to the drawings.

In the following description, the term "aluminum" encompasses aluminum alloys in addition to pure aluminum. Also, in the following description, the left-hand side and right-hand side of FIG. 1 will be referred to as "left" and "right," respectively.

Further, like portions and members are denoted by like reference numerals throughout the drawings.

Figure 2:
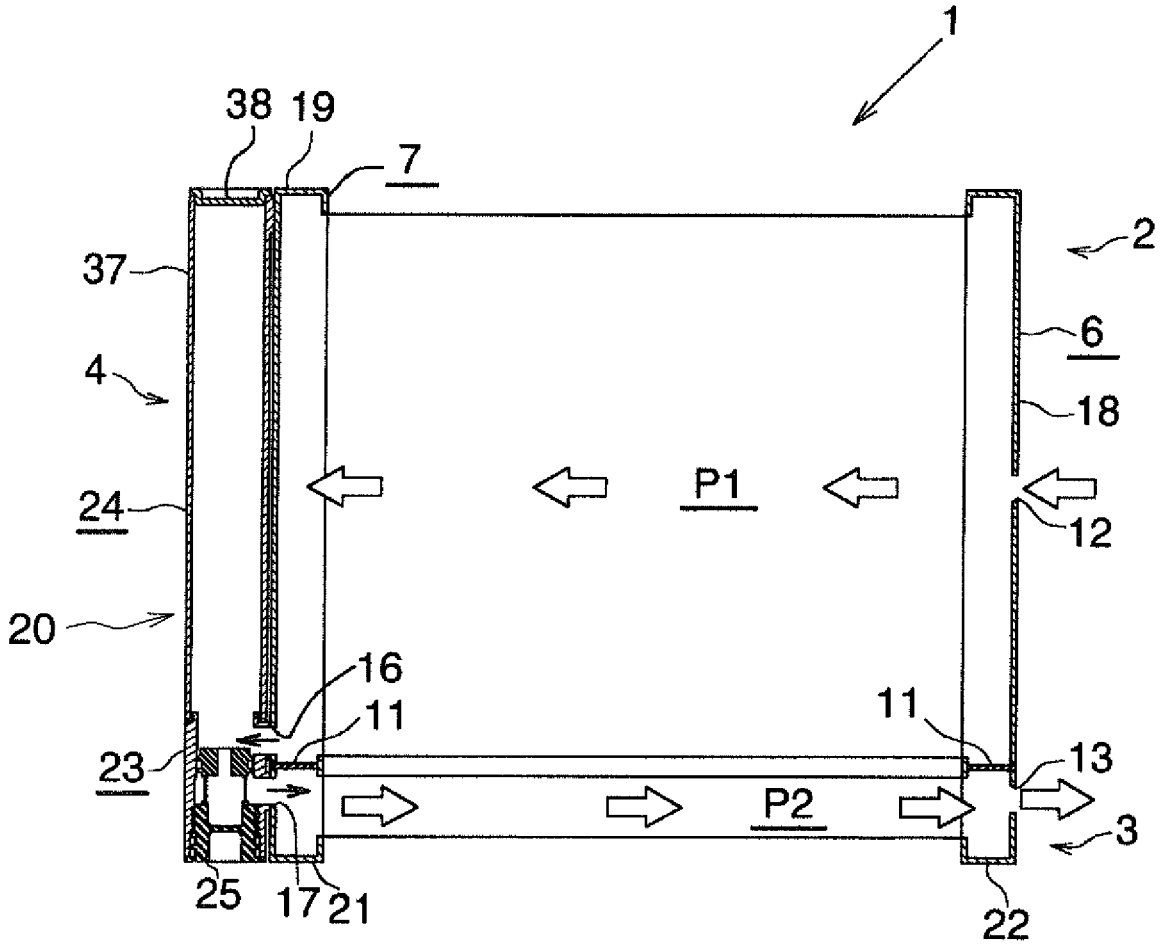
FIG. 2 is a front view schematically showing the condenser of FIG. 1.
Figure 3:
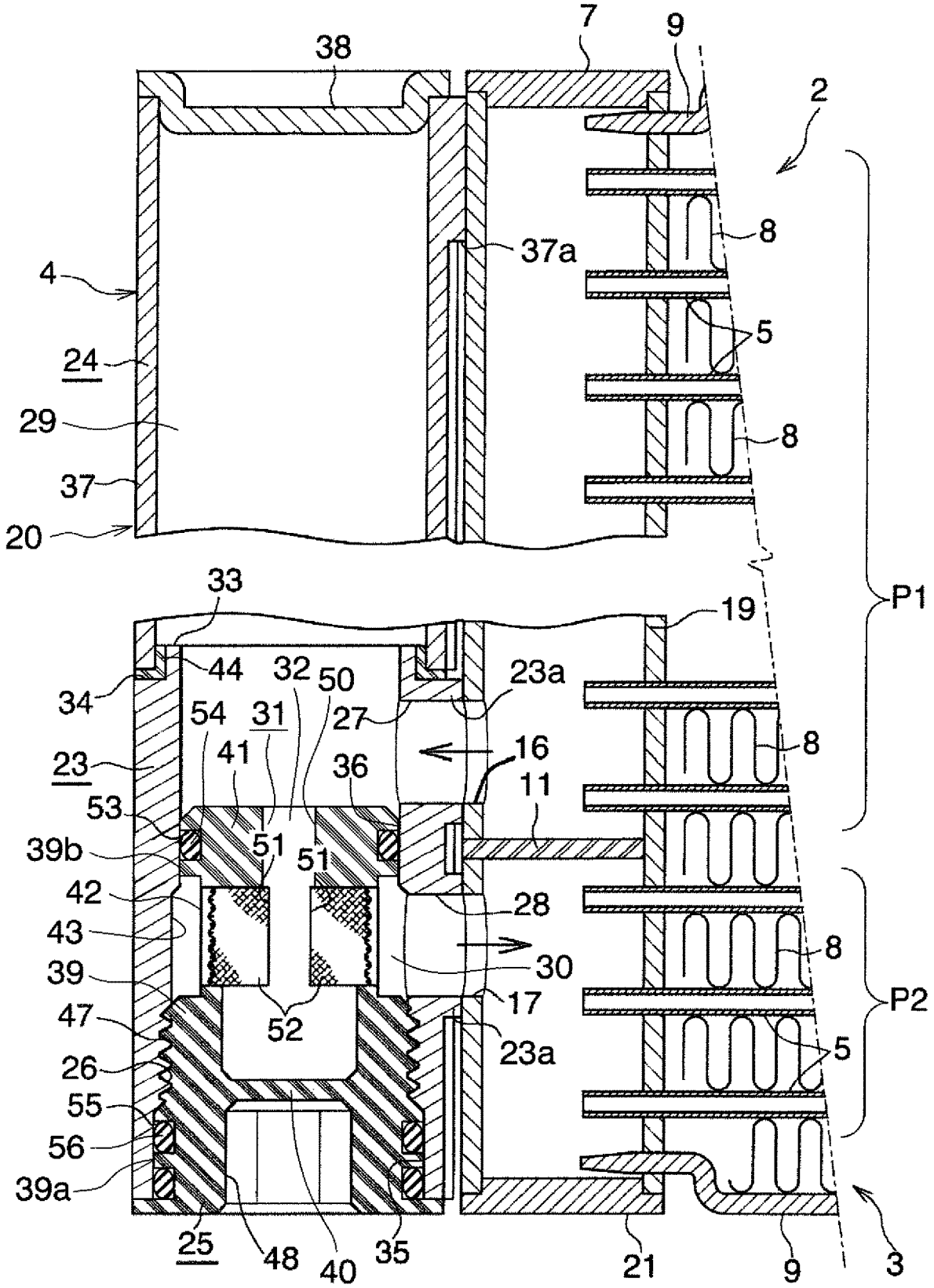
FIG. 3 is a partially cutaway vertical sectional view showing, on an enlarged scale, a left header tank and a liquid receiver of the condenser of FIG. 1 as viewed from the front side.
Figure 4:
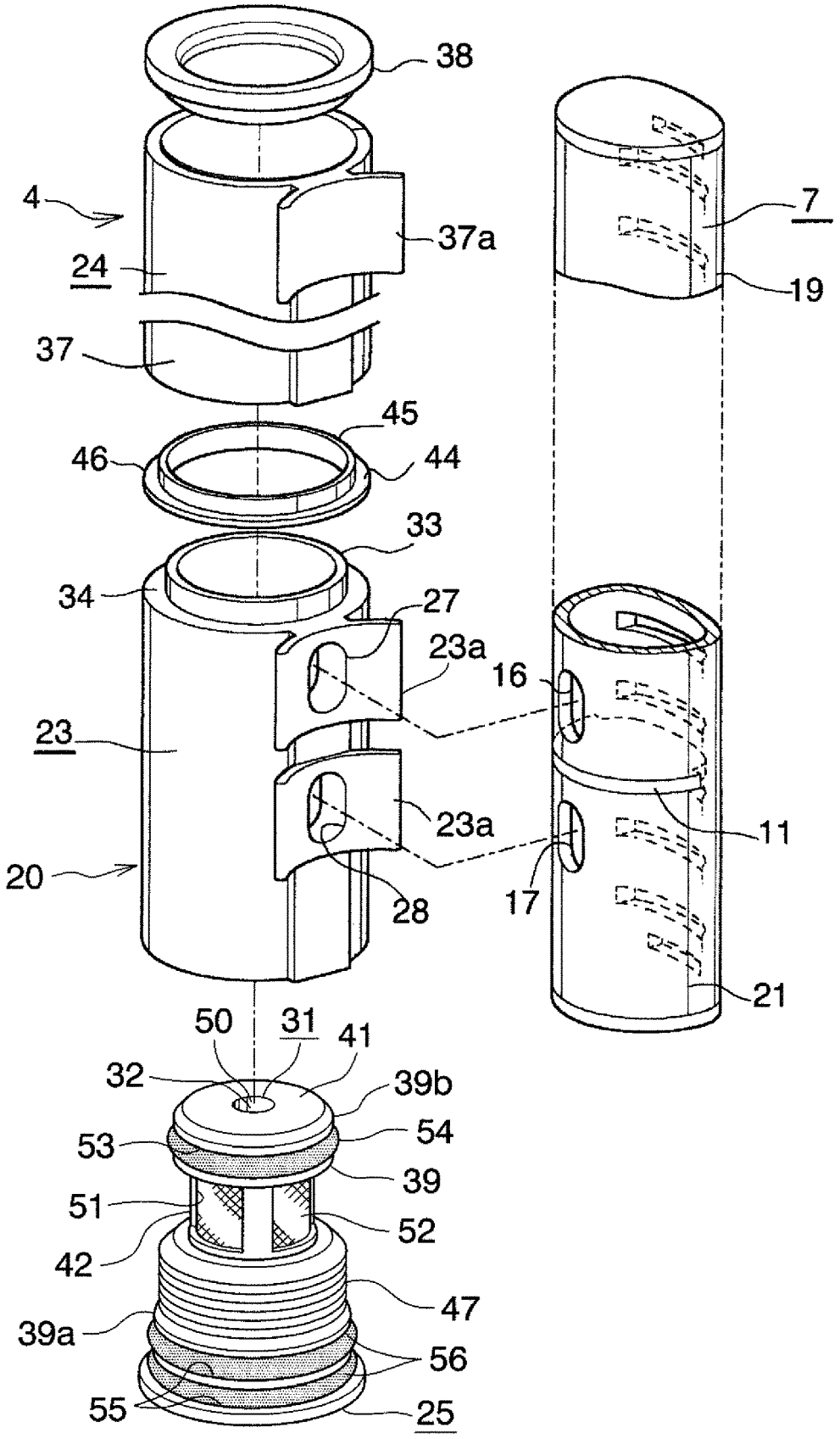
FIG. 4 is a partially cutaway exploded view showing the left header tank and the liquid receiver of the condenser of FIG. 1.

FIG. 1 specifically shows the overall structure of a condenser according to the present invention. FIG. 2 schematically shows the condenser of FIG. 1. FIGS. 3 and 4 show the structure of a main portion of the condenser of FIG. 1. In FIG. 2, individual heat exchange tubes are not illustrated, and corrugate fins, side plates, a refrigerant inlet member, and a refrigerant outlet member are also not illustrated.

In FIGS. 1 and 2, a condenser 1 is composed of a condensation section 2; a supercooling section 3 provided below the condensation section 2; and a tank-like liquid receiver 4 which is formed of aluminum and is provided between the condensation section 2 and the supercooling section 3 such that the longitudinal direction of the liquid receiver 4 coincides with the vertical direction. The liquid receiver 4 separates gas-liquid-mixed-phase refrigerant produced as a result of condensation at the condensation section 2 into gas-phase refrigerant and liquid-phase refrigerant, stores the liquid-phase refrigerant, and supplies the liquid-phase refrigerant to the supercooling section 3. The condenser 1 constitutes a refrigeration cycle in cooperation with a compressor, an expansion valve (pressure reducer), and an evaporator; and the refrigeration cycle is mounted on a vehicle as a car air conditioner.

The condenser 1 includes a plurality of flat heat exchange tubes 5 formed of aluminum, two header tanks 6 and 7 formed of aluminum, corrugate fins 8 formed of aluminum, and side plates 9 formed of aluminum. The heat exchange tubes 5 are disposed such that their width direction coincides with an air-passing direction, their longitudinal direction coincides with the left-right direction, and they are spaced from one another in the vertical direction. The header tanks 6 and 7 are disposed such that their longitudinal direction coincides with the vertical direction and they are spaced from each other in the left-right direction, and left and right end portions of the heat exchange tubes 5 are connected to the header tanks 6 and 7. Each of the corrugate fins 8 is disposed between adjacent heat exchange tubes 5 and joined thereto through use of a brazing material, or is disposed on the outer side of the uppermost or lowermost heat exchange tube 5 and joined to the corresponding heat exchange tube 5 through use of a brazing material. The side plates 9 are disposed on the corresponding outer sides of the uppermost and lowermost corrugate fins 8, and are joined to these corrugate fins 8 through use of a brazing material. In the following description, joining through use of a brazing material will also referred to as "brazing."

Each of the condensation section 2 and the supercooling section 3 of the condenser 1 includes at least one heat exchange path (in the present embodiment, one heat exchange path P1, P2) formed by a plurality of heat exchange tubes 5 successively arranged in the vertical direction. The heat exchange path P1 provided in the condensation section 2 serves as a refrigerant condensation path. The heat exchange path P2 provided in the supercooling section 3 serves as a refrigerant supercooling path. The flow direction of refrigerant is the same among all the heat exchange tubes 5 which form each heat exchange path P1, P2. The flow direction of refrigerant in the heat exchange tubes 5 which form a certain heat exchange path is opposite the flow direction of refrigerant in the heat exchange tubes 5 which form another heat exchange path adjacent to the certain heat exchange path. The heat exchange path P1 of the condensation section 2 will be referred to as the first heat exchange path, and the heat exchange path P2 of the supercooling section 3 will be referred to as the second heat exchange path. In the present embodiment, one heat exchange path is provided in each of the condensation section 2 and the supercooling section 3; however, the number of heat exchange paths is not limited thereto and may be changed freely, provided that the downstream (in the refrigerant flow direction) ends of the heat exchange tubes 5 of the heat exchange path located furthest downstream in the refrigerant flow direction in the condensation section 2 and the upstream (in the refrigerant flow direction) ends of the heat exchange tubes 5 of the heat exchange path located furthest upstream in the refrigerant flow direction in the supercooling section 3 are located on the same side; i.e., are located on the left side or the right side. In the present embodiment, since the single heat exchange path P1 is provided in the condensation section 2, the first heat exchange path P1 serves as a heat exchange path located furthest upstream in the refrigerant flow direction in the condensation section 2 and also serves as a heat exchange path located furthest downstream in the refrigerant flow direction in the condensation section 2. Similarly, since the single heat exchange path P2 is provided in the supercooling section 3, the second heat exchange path P2 serves as a heat exchange path located furthest upstream in the refrigerant flow direction in the supercooling section 3 and also serves as a heat exchange path located furthest downstream in the refrigerant flow direction in the supercooling section 3.

The header tanks 6 and 7 have respective partition members 11 which are formed of aluminum and are provided at the same vertical position on the lower side between the first heat exchange path P1 and the second heat exchange path P2 so as to divide the interior spaces of the header tanks 6 and 7 into upper and lower spaces. A portion of the condenser 1 located on the upper side of the two partition members 11 is the condensation section 2, and a portion of the condenser 1 located on the lower side of the two partition members 11 is the supercooling section 3.

The right header tank 6 has a refrigerant inlet 12 formed in a portion of the circumferential wall thereof located above the corresponding partition member 11, and gas-phase refrigerant compressed by the compressor flows into the refrigerant inlet 12. The right header tank 6 has a refrigerant outlet 13 formed in a portion of the circumferential wall thereof located below the corresponding partition member 11, and liquid-phase refrigerant flows out through the refrigerant outlet 13 toward the expansion valve. A refrigerant inlet member 14 formed of aluminum and having an internal passage communicating with the refrigerant inlet 12 and a refrigerant outlet member 15 formed of aluminum and having an internal passage communicating with the refrigerant outlet 13 are brazed to the right header tank 6. The left header tank 7 has a refrigerant outlet 16 formed in a portion of the circumferential wall thereof located above the corresponding partition member 11, and gas-liquid-mixed-phase refrigerant flows into the liquid receiver 4 through the refrigerant outlet 16. The left header tank 7 has a refrigerant inlet 17 formed in a portion of the circumferential wall thereof located below the corresponding partition member 11, and liquid-phase refrigerant flows into the supercooling section 3 through the refrigerant inlet 17. Therefore, the space of the right header tank 6 located above the corresponding partition member 11 serves as a condensation section inlet header 18, the space of the left header tank 7 located above the corresponding partition member 11 serves as a condensation section outlet header 19, the space of the left header tank 7 located below the corresponding partition member 11 serves as a supercooling section inlet header 21, and the space of the right header tank 6 located below the corresponding partition member 11 serves as a supercooling section outlet header 22.

As shown in FIGS. 3 and 4, the liquid receiver 4 is composed of a liquid receiver main body 20 whose longitudinal direction coincides with the vertical direction and which has a closed upper end and an open lower end, and a plug 25 which is removably fitted into the liquid receiver main body 20 from the lower side and closes the opening of the liquid receiver main body 20 at the lower end thereof. A refrigerant inflow hole 27 into which refrigerant flows from the condensation section outlet header 19 and a refrigerant outflow hole 28 from which refrigerant flows into the supercooling section inlet header 21 are formed in the liquid receiver main body 20 such that the refrigerant inflow hole 27 is spaced from the refrigerant outflow hole 28 in the vertical direction and is located above the refrigerant outflow hole 28.

The liquid receiver 4 has a first space 29 which is formed above the upper end of the plug 25 and with which the refrigerant inflow hole 27 communicates and a second space 30 which is formed below the upper end of the plug 25 and with which the refrigerant outflow hole 28 communicates. The plug 25 has a flow passage 31 whose one end is open to the first space 29 and whose other end is open to the second space 30. A throttle portion 32 whose cross-sectional area is smaller than the hole area of the refrigerant inflow hole 27 is provided in the flow passage 31.

The liquid receiver main body 20 of the liquid receiver 4 is composed of a cylindrical base member 23 whose axial direction coincides with the vertical direction and a cylindrical tank member 24 whose longitudinal direction coincides with the vertical direction. The base member 23 is brazed to the left header tank 7 and is open at upper and lower ends thereof. A lower end portion of the tank member 24 is fixed to the base member 23. The tank member 24 is closed at its upper end and is open at its lower end. The internal space of the tank member 24 communicates with the internal space of the base member 23.

The base member 23 is formed of aluminum bare material such as aluminum extrudate. The base member 23 has a female screw 26 which is formed in a vertically intermediate region of the inner circumferential surface thereof (in the present embodiment, in a region of the inner circumferential surface located slightly below the center thereof in the vertical direction). In a portion of the base member 23 located above the female screw 26, the refrigerant inflow hole 27 communicating with the refrigerant outlet 16 of the condensation section outlet header 19 and the refrigerant outflow hole 28 communicating with the refrigerant inlet 17 of the supercooling section inlet header 21 are formed at a predetermined interval in the vertical direction such that the refrigerant inflow hole 27 is located above the refrigerant outflow hole 28.

Fixing lugs **23*a* are integrally provided in regions of the outer circumferential surface of the base member 23, which regions correspond to the refrigerant inflow hole 27 and the refrigerant outflow hole 28, respectively. The fixing lugs 23*a* have arcuate close contact surfaces which come into close contact with the outer surface of the left header tank 7 of the condenser 1. The opposite ends of the refrigerant inflow hole 27 are open to the inner circumferential surface of the base member 23 and the close contact surface of the upper fixing lug 23*a*, and the opposite ends of the refrigerant outflow hole 28 are open to the inner circumferential surface of the base member 23 and the close contact surface of the lower fixing lug 23*a*. The upper fixing lug 23*a* is brazed to the outer surface of the left header tank 7 such that the refrigerant inflow hole 27 coincides with the refrigerant outlet 16 of the condensation section outlet header 19, and the lower fixing lug 23*a* is brazed to the outer surface of the left header tank 7 such that the refrigerant outflow hole 28 coincides with the refrigerant inlet 17 of the supercooling section inlet header 21**.

A cylindrical tubular insertion portion 33 having a reduced outer diameter is provided at the upper end of the base member 23 via a step portion 34. Further, a cylindrical lower seal surface 35 whose diameter is larger than the root diameter of the female screw 26 is provided in a region of the inner circumferential surface of the base member 23, which region is located below the female screw 26, and a cylindrical upper seal surface 36 whose diameter is smaller than the inner diameter of the female screw 26 is provided in another region of the inner circumferential surface of the base member 23, which region is located above the female screw 26. The base member 23 is formed by performing cutting and threading on an extrudate having the same shape as the outline of the cross section of the portions where the two fixing lugs **23*a*** are provided.

The tank member 24 is composed of a cylindrical body 37 which is formed of aluminum bare material such as aluminum extrudate, whose longitudinal direction coincides with the vertical direction, and which is open at its upper and lower ends; and a closing member 38 which is formed of an aluminum brazing sheet and which is joined to the upper end of the cylindrical body 37 so as to close the upper end opening.

A spacer portion **37*a* is integrally provided at the upper end of the cylindrical body 37 of the tank member 24. The spacer portion 37*a* has an arcuate close contact surface which comes into close contact with the outer surface of the left header tank 7 of the condenser 1. The inner diameter of the cylindrical body 37 is larger than the outer diameter of the insertion portion 33 of the base member 23. The spacer portion 37*a* is brazed to the outer surface of the left header tank 7. The cylindrical body 37 is formed by performing cutting on an extrudate having the same shape as the outline of the cross section of the portion of the cylindrical body 37 where the spacer portion 37***a* is provided.

The base member 23 and the cylindrical body 37 of the tank member 24 are joined together with a connection ring 44 intervening therebetween. The connection ring 44 is formed by performing press working on an aluminum brazing sheet and has a short cylindrical portion 45 which is present between the outer circumferential surface of the insertion portion 33 of the base member 23 and the inner circumferential surface of the cylindrical body 37 and an outward flange 46 which is integrally provided at the lower end of the short cylindrical portion 45 and is present between the step portion 34 of the base member 23 and the lower end surface of the cylindrical body 37. The short cylindrical portion 45 of the connection ring 44 is brazed to the outer circumferential surface of the insertion portion 33 of the base member 23 and the inner circumferential surface of the cylindrical body 37, and the outward flange 46 is brazed to the step portion 34 of the base member 23 and the lower end surface of the cylindrical body 37, whereby the base member 23 and the cylindrical body 37 of the tank member 24 are joined together with the connection ring 44 intervening therebetween.

The plug 25 is formed of a synthetic resin as a single member. The plug 25 has a circumferential wall portion 39 whose outer circumferential surface is a stepped cylindrical surface, a lower partition wall portion 40 which is provided on the circumferential wall portion 39 at a position below the refrigerant outflow hole 28 and which separates the inside of the circumferential wall portion 39 and the outside of the liquid receiver 4 from each other, and an upper partition wall portion 41 which is provided on the circumferential wall portion 39 at a position above the refrigerant outflow hole 28 and which separates the inside of the circumferential wall portion 39 and the first space 29 from each other. The upper end of the circumferential wall portion 39 of the plug 25 is located at a vertical position between the refrigerant inflow hole 27 and the refrigerant outflow hole 28.

A lower portion (large diameter portion 39*a*) of the outer circumferential surface of the circumferential wall portion 39 of the plug 25 is greater in diameter than an upper portion (small diameter portion 39*b*) thereof. The plug 25 has a male screw 47 formed on the large diameter portion 39*a* of the cylindrical outer circumferential surface at a position below the refrigerant outflow hole 28. The male screw 47 is brought into screw engagement with the female screw 26 of the base member 23, whereby the plug 25 is removably fitted into the base member 23. One annular O-ring groove 53 is formed in a region of the small diameter portion 39*b* of the outer circumferential surface of the circumferential wall portion 39 of the plug 25, which region is located between the refrigerant inflow hole 27 and the refrigerant outflow hole 28. An O-ring 54 (seal member) fitted into the O-ring groove 53 establishes sealing between a region of the outer circumferential surface of the circumferential wall portion 39 of the plug 25, which region is located above the refrigerant inflow hole 28, and the upper seal surface 36 of the inner circumferential surface of the base member 23 located between the refrigerant inflow hole 27 and the refrigerant outflow hole 28. Further, two annular O-ring grooves 55 are formed in a region of the outer circumferential surface of the plug 25, which region is located below the male screw 47, such that the two annular O-ring grooves 55 are spaced from each other in the vertical direction. O-rings 56 (lower seal members) fitted into the O-ring groove 55 establish sealing between a region of the outer circumferential surface of the plug 25, which region is located below the male screw 47, and the lower seal surface 35 of the inner circumferential surface of the base member 23 located below the female screw 26.

At a position located below the upper O-ring 54 and above the female screw 26 and the male screw 47, an annular groove 42 is formed in the small diameter portion 39*b* of the outer circumferential surface of the circumferential wall portion 39 of the plug 25, and an annular groove 43 is formed on the inner circumferential surface of the base member 23. As a result, a second space 30 communicating with the refrigerant outflow hole 28 is formed between the small diameter portion 39*b* of the outer circumferential surface of the circumferential wall portion 39 of the plug 25 and the inner circumferential surface of the base member 23. An upper through hole 50 (first through hole) is formed at the center of the upper partition wall portion 41 of the plug 25. The upper through hole 50 is smaller in hole area than the refrigerant inflow hole 27 and establishes communication between the first space 29 and the space inside the circumferential wall portion 39. Also, a plurality of lower through holes 51 (second through holes) for establishing communication between the second space 30 and the space inside the circumferential wall portion 39 are formed, at predetermined intervals in the circumferential direction, in a region of the circumferential wall portion 39 of the plug 25 located between the upper O-ring groove 53 and the male screw 47. A meshed filter 52 is provided to cover the lower through holes 51. The space inside the circumferential wall portion 39 and the through holes 50 and 51 form a flow passage 31 which is open to the first space 29 at one end thereof and is open to the second space 30 at the other end. The upper through hole 50 serves as the throttle portion 32 whose cross-sectional area is smaller than the hole area of the refrigerant inflow hole 27.

Notably, the plug 25 has a blind tool hole 48 which is formed inside the circumferential wall portion 39 of the plug 25 to be located below the lower partition wall portion 40 and which is open downward. A tool for rotating the plug 25 is inserted into the tool hole 48.

Although not illustrated, a desiccant bag is disposed in the first space 29 located above the plug 25 within the liquid receiver such that the longitudinal direction of the desiccant bag coincides with the vertical direction. The desiccant bag has gas permeability and liquid permeability and which contains a desiccant.

In a car air conditioner including the condenser 1 having the above-described structure, gas-phase refrigerant of high temperature and high pressure compressed by the compressor flows into the condensation section inlet header 18 of the right header tank 6 through the refrigerant inlet member 14 and the refrigerant inlet 12. The refrigerant is condensed while flowing leftward within the heat exchange tubes 5 of the first heat exchange path 21 and flows into the condensation section outlet header 19 of the left header tank 7. The refrigerant having flowed into the condensation section outlet header 19 of the left header tank 7 passes through the header side refrigerant outlet 16 and the refrigerant inflow hole 27 and enters the first space 29 within the liquid receiver 4.

Since the refrigerant having flowed into the first space 29 within the liquid receiver 4 is gas-liquid-mixed-phase refrigerant, liquid-phase refrigerant which is a portion of the gas-liquid-mixed-phase refrigerant accumulates in a lower portion of the interior space of the liquid receiver 4 due to the gravitational force, and gas-phase refrigerant which is a portion of the gas-liquid-mixed-phase refrigerant accumulates in an upper portion of the interior space of the liquid receiver 4. The liquid-phase refrigerant flows through the flow passage 31 of the plug 25 and flows into the second space 30 of the liquid receiver 4. Subsequently, the liquid-phase refrigerant flows through the refrigerant outflow hole 28 and flows into the supercooling section inlet header 21. Since the opening of the flow passage 31 of the plug 25 on the first space 29 side; i.e., the upper end opening of the upper through hole 50, is located at a vertical position below the refrigerant inflow hole 27, liquid-phase refrigerant of high density which is a portion of the gas-liquid-mixed-phase refrigerant having flowed into the first space 29 of the liquid receiver 4 through the refrigerant inflow hole 27 becomes more likely to flow into the second space 30 through the flow passage 31 as compared with gas-phase refrigerant of low density. In addition, since the throttle portion 32 whose cross-sectional area is smaller than the hole area of the refrigerant inflow hole 27 is provided in the flow passage 31 of the plug 25, as a result of the action of the throttle portion 32, the gas-phase refrigerant which is a portion of the gas-liquid-mixed-phase refrigerant having flowed into the first space 29 of the liquid receiver 4 through the refrigerant inflow hole 27 and which is large in specific volume becomes less likely to flow through the flow passage 31, and the liquid-phase refrigerant which is small in specific volume becomes more likely to flow into the second space 30 through the flow passage 31. Accordingly, the gas liquid separation performance of the liquid receiver 4 is enhanced.

The refrigerant having entered the supercooling section inlet header 21 of the left header tank 7 is super-cooled while flowing rightward within the heat exchange tubes 5 of the second heat exchange path P2, and enters the supercooling section outlet header 22 of the right header tank 6. Subsequently, the super-cooled refrigerant flows out through the refrigerant outlet 13 and the refrigerant outlet member 15, and is then fed to the evaporator through the expansion valve.

Since the opening of the flow passage 31 of the plug 25 on the first space 29 side is located at a vertical position below the refrigerant inflow hole 27, when refrigerant is charged into a car air conditioner using the above-described condenser, the refrigerant having flowed from the condensation section outlet header 19 into the first space 29 of the liquid receiver 4 flows into the supercooling section inlet header 21 at a relatively early stage through the flow passage 31 of the plug 25, the second space 30, and the refrigerant outflow hole 28. Therefore, the heat exchange tubes 5 of the second heat exchange path P2 can be filled with liquid-phase refrigerant at a relatively early stage, and the amount of refrigerant required to reach a stable region where the degree of supercooling becomes constant can be made smaller as compared with the condenser disclosed in Japanese Patent Application Laid-Open No. 2010-185648. Accordingly, the amount of refrigerant to be charged can be reduced.

FIGS. 5 to 8 show a modification of the plug used in the liquid receiver 4 of the condenser 1 shown in FIG. 1.

Figure 5:
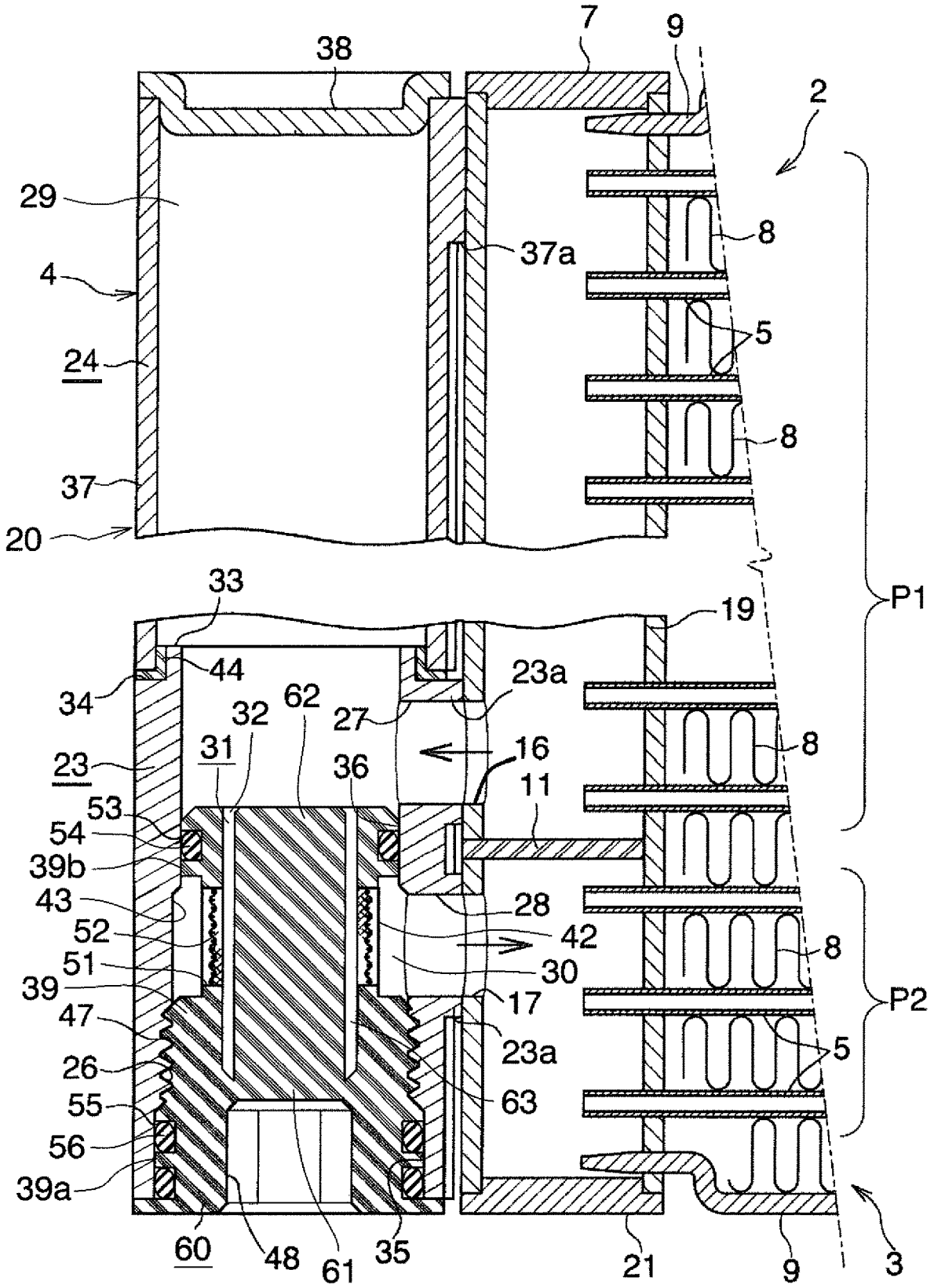
FIG. 5 is a view corresponding to FIG. 3 and showing a modification of the plug used in the liquid receiver of the condenser shown in FIG. 1.
Figure 6:
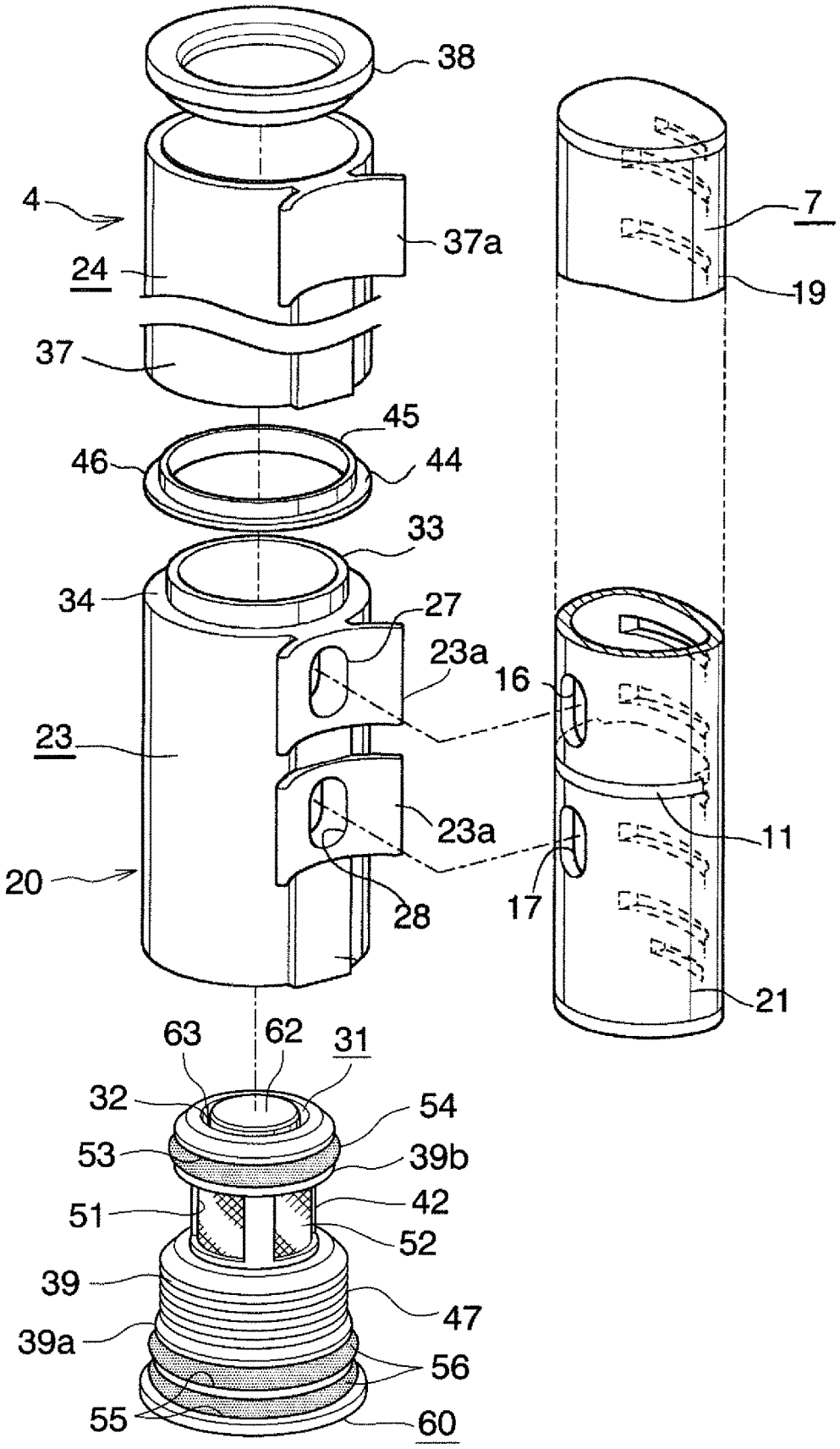
FIG. 6 is a view corresponding to FIG. 4 and showing the plug of FIG. 5.

A plug 60 shown in FIGS. 5 and 6 is formed of a synthetic resin as a single member. The plug 60 has a circumferential wall portion 39 whose outer circumferential surface is a stepped cylindrical surface, a partition wall portion 61 which is provided on the circumferential wall portion 39 at a position below the refrigerant outflow hole 28 and which separates the inside of the circumferential wall portion 39 and the outside of the liquid receiver 4 from each other, and a circular columnar upward protruding portion 62 provided on the partition wall portion 61.

A refrigerant flow gap 63 is formed between the inner circumferential surface of the circumferential wall portion 39 of the plug 60 and the outer circumferential surface of the upward protruding portion 62 such that the refrigerant flow gap 63 extends over the entire circumference. The refrigerant flow gap 63 is open upward and communicates with the first space 29 of the liquid receiver 4 located above the plug 60. Each of a portion of the inner circumferential surface of the circumferential wall portion 39 of the plug 60 located above the partition wall portion 61 and the outer circumferential surface of the upward protruding portion 62 is a cylindrical surface whose diameter is constant over its entirety in the vertical direction. Therefore, the cross-sectional area of the refrigerant flow gap 63 is constant over its entirety in the vertical direction. The area of the upper end opening of the refrigerant flow gap 63 is smaller than the hole area of the refrigerant inflow hole 27. The refrigerant flow gap 63 and the lower through holes 51 form the flow passage 31 which is open to the first space 29 at one end thereof and is open to the second space 30 at the other end. The refrigerant flow gap 63 serves as the throttle portion 32 whose cross-sectional area is smaller than the hole area of the refrigerant inflow hole 27. Notably, the upper end of the upward protruding portion 62 is located at the same vertical position as the upper end of the circumferential wall portion 39.

The structure of the remaining portion is identical with that of the plug 25 shown in FIGS. 3 and 4.

Figure 7:
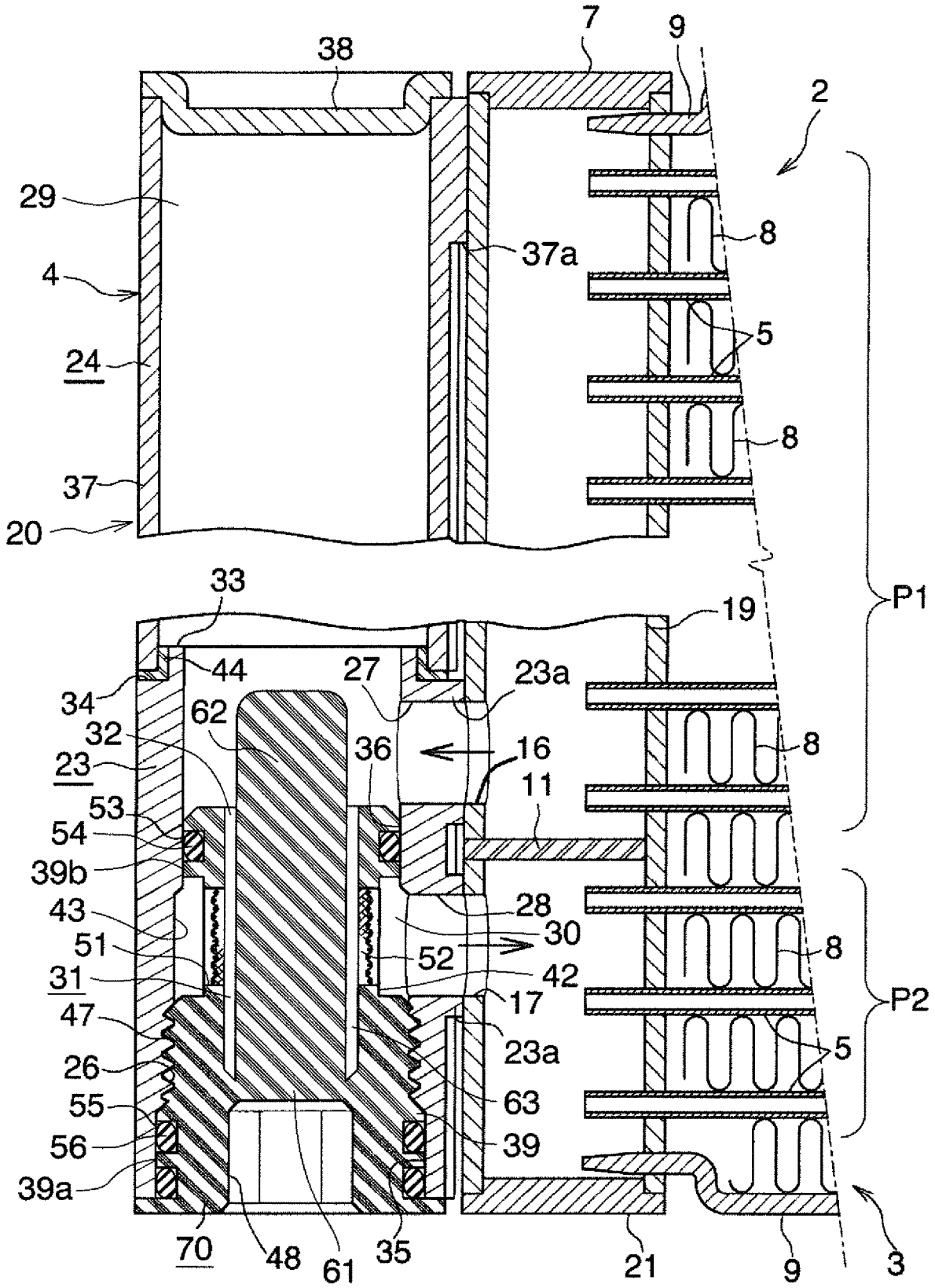
FIG. 7 is a view corresponding to FIG. 3 and showing another modification of the plug used in the liquid receiver of the condenser shown in FIG. 1.
Figure 8:
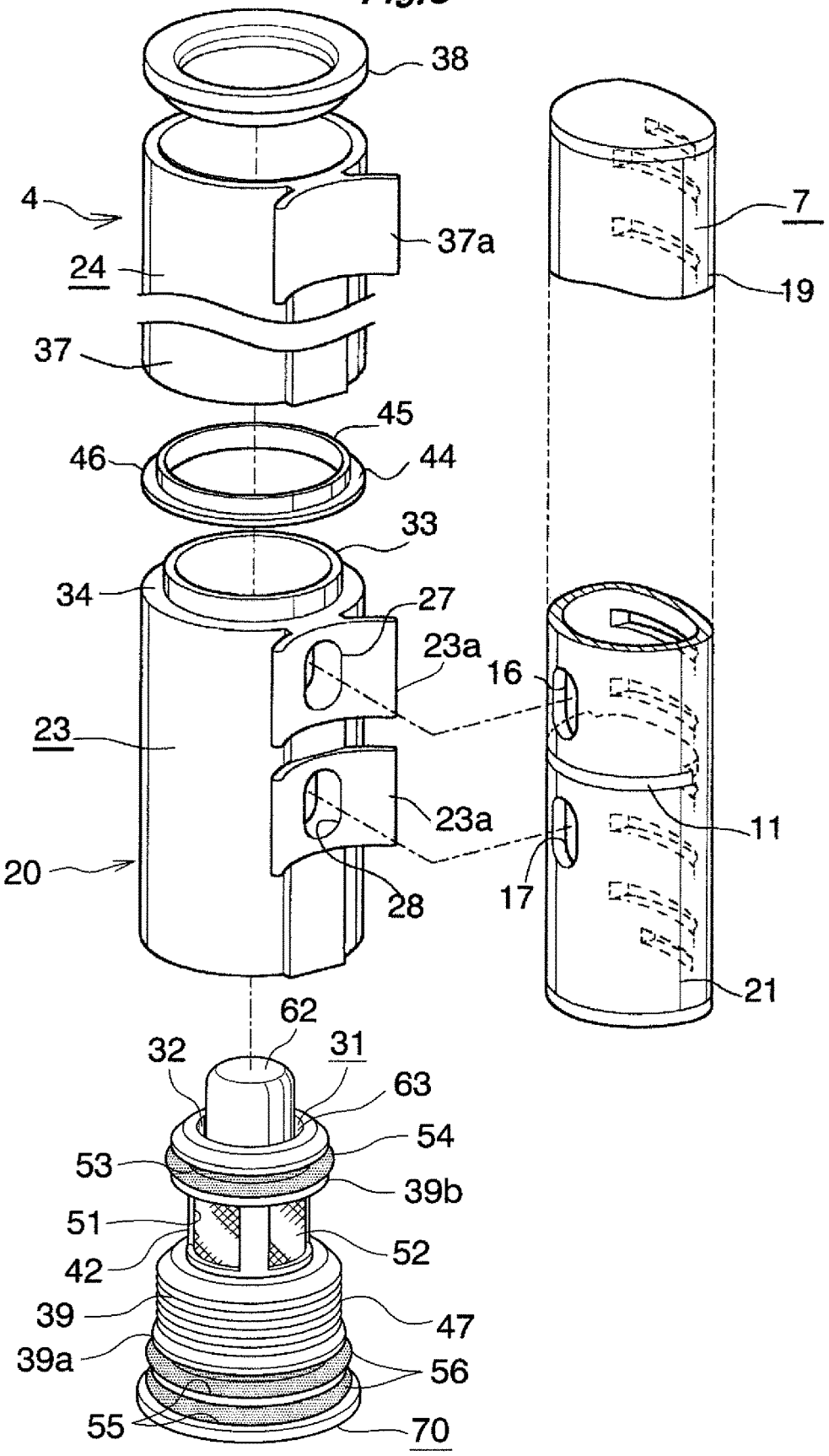
FIG. 8 is a view corresponding to FIG. 4 and showing the plug of FIG. 7.

In a case of a plug 70 shown in FIGS. 7 and 8, the upper end of the upward protruding portion 62 protrudes upward beyond the upper end of the circumferential wall portion 39. In this modification, the upper end of the upward protruding portion 62 is located at a vertical position equal to or higher than the vertical position of the upper end of the refrigerant inflow hole 27. Thus, refrigerant having flowed into the liquid receiver 4 through the refrigerant inflow hole 27 hits against the outer circumferential surface of the upward protruding portion 62.

In a car air conditioner in which the condenser 1 including the plug 70 is used, the refrigerant having flowed from the condensation section outlet header 19 into the first space 29 within the liquid receiver 4 through the refrigerant inflow hole 27 hits against the outer circumferential surface of the upward protruding portion 62. Therefore, the flow velocity of the refrigerant can be decreased so as to suppress the influence of inertial force and increase the influence of gravitational force. Accordingly, the gas-liquid-mixed-phase refrigerant having flowed from the condensation section outlet header 19 into the first space 29 of the liquid receiver 4 through the refrigerant inflow hole 27 is efficiently separated into gas-phase refrigerant and liquid-phase refrigerant, and liquid-phase refrigerant of high density becomes more likely to flow into the second space 30 through the flow passage 31 as compared with gas-phase refrigerant of low density. As a result, the gas liquid separation performance of the liquid receiver 4 is enhanced further.

The structure of the remaining portion is identical with that of the plug 60 shown in FIGS. 5 and 6.

The present invention comprises the following modes.

1) A condenser comprising: a condensation section which includes a condensation section outlet header disposed such that its longitudinal direction coincides with a vertical direction and a plurality of heat exchange tubes whose longitudinal direction coincides with a left-right direction and each of which is connected, at one end in the longitudinal direction, to the condensation section outlet header; a supercooling section which is provided below the condensation section and which includes a supercooling section inlet header disposed below the condensation section outlet header such that the longitudinal direction of the supercooling section inlet header coincides with the vertical direction and a plurality of heat exchange tubes whose longitudinal direction coincides with the left-right direction and each of which is connected, at one end in the longitudinal direction, to the supercooling section inlet header; and a liquid receiver which is provided between the condensation section and the supercooling section and which receives gas-liquid-mixed-phase refrigerant from the condensation section and separates the gas-liquid-mixed-phase refrigerant into gas-phase refrigerant and liquid-phase refrigerant, the liquid receiver including a liquid receiver main body whose longitudinal direction coincides with a vertical direction and which has a closed upper end and an open lower end, and a plug removably fitted into the liquid receiver main body from below so as to close a lower end opening of the liquid receiver main body, the liquid receiver main body having a refrigerant inflow hole into which refrigerant flows from the condensation section outlet header and a refrigerant outflow hole from which refrigerant flows into the supercooling section inlet header, the refrigerant inflow hole and the refrigerant outflow hole being formed at an interval in the vertical direction such that the refrigerant inflow hole is located above the refrigerant outflow hole, wherein the liquid receiver has a first space which is formed above an upper end of the plug and with which the refrigerant inflow hole communicates and a second space which is formed below the upper end of the plug and with which the refrigerant outflow hole communicates; the plug has a flow passage one end of which is open to the first space and the other end of which is open to the second space; an opening of the flow passage on the first space side is located at a vertical position below the refrigerant inflow hole; and a throttle portion having a cross-sectional area smaller than a hole area of the refrigerant inflow hole is provided in the flow passage.

2) The condenser described in par. 1), wherein the upper end of the plug is located at a vertical position between the refrigerant inflow hole and the refrigerant outflow hole; a seal member is provided for sealing between a portion of an outer circumferential surface of the plug, which portion is located above the refrigerant outflow hole, and a portion of an inner circumferential surface of the liquid receiver main body, which portion is located between the refrigerant inflow hole and the refrigerant outflow hole; and at a position below the seal member, the second space is formed between the outer circumferential surface of the plug and the inner circumferential surface of the liquid receiver main body.

3) The condenser described in par. 2), wherein the plug has a tubular circumferential wall portion, a lower partition wall portion provided on a portion of the circumferential wall portion located below the refrigerant outflow hole so as to separate a space inside the circumferential wall portion and a space outside the liquid receiver from each other, and an upper partition wall portion provided on a portion of the circumferential wall portion located above the refrigerant outflow hole so as separate the space inside the circumferential wall portion and the first space from each other; the second space is formed between an outer circumferential surface of the circumferential wall portion of the plug and the inner circumferential surface of the liquid receiver main body; the upper partition wall portion has a first through hole which has a hole area smaller than the hole area of the refrigerant inflow hole and which establishes communication between the space inside the circumferential wall portion and the first space; the circumferential wall portion has a second through hole which establishes communication between the space inside the circumferential wall portion and the second space; the flow passage is formed by the space inside the circumferential wall portion and the first and second through holes; and the first through hole serves as the throttle portion.

4) The condenser described in par. 1), wherein the plug has a tubular circumferential wall portion, a partition wall portion provided on a portion of the circumferential wall portion located below the refrigerant outflow hole so as to separate a space inside the circumferential wall portion and a space outside the liquid receiver from each other, and an upward protruding portion provided on the partition wall portion; an upper end of the circumferential wall portion of the plug is located at a vertical position between the refrigerant inflow hole and the refrigerant outflow hole; a seal member is provided for sealing between a portion of an outer circumferential surface of the circumferential wall portion located above the refrigerant outflow hole and a portion of an inner circumferential surface of the liquid receiver main body located between the refrigerant inflow hole and the refrigerant outflow hole; at a position below the seal member, the second space is formed between the outer circumferential surface of the circumferential wall portion of the plug and the inner circumferential surface of the liquid receiver main body; a refrigerant flow gap which is open upward and communicates with the first space is formed between an inner circumferential surface of the circumferential wall portion of the plug and an outer circumferential surface of the upward protruding portion over the entire circumference; the refrigerant flow gap has a constant cross-sectional area over its entirety in the vertical direction; an upper end opening of the refrigerant flow gap has an area smaller than the hole area of the refrigerant inflow hole; the circumferential wall portion of the plug has a through hole for establishing communication between the refrigerant flow gap and the second space; the flow passage is formed by the refrigerant flow gap and the through hole of the circumferential wall portion; and the refrigerant flow gap serves as the throttle portion.

5) The condenser described in par. 4), wherein an upper end of the upward protruding portion is located at a vertical position above an lower end of the refrigerant inflow hole, so that refrigerant flowing into the liquid receiver through the refrigerant inflow hole hits against the outer circumferential surface of the upward protruding portion.

6) The condenser described in par. 5), wherein the upper end of the upward protruding portion is located at a vertical position which is the same as or above an upper end of the refrigerant inflow hole.

7) The condenser described in any of pars. 1) to 6), wherein a female screw portion is provided on a portion of an inner circumferential surface of the liquid receiver main body located below the refrigerant outflow hole; a male screw portion is provided on a vertically intermediate portion of an outer circumferential surface of the plug located below the refrigerant outflow hole: the male screw portion is screwed into the female screw portion of the liquid receiver main body; and a lower seal member is provided for sealing between a portion of the inner circumferential surface of the liquid receiver main body located below the female screw portion and a portion of the outer circumferential surface of the plug located below the male screw portion.

8) The condenser described in any of pars. 1) to 7), wherein the condensation section has a condensation section outlet header; the supercooling section has a supercooling section inlet header; the condensation section outlet header and the supercooling section inlet header are provided in a single header tank; the liquid receiver main body of the liquid receiver is composed of a tubular base member which is open at upper and lower ends thereof and is joined to the header tank, and a tubular tank member which is closed at its upper end and is open at its lower end and whose lower end portion is fixed to the base member; and the plug is fitted into the base member from below.

In the condenser according to any one of pars. 1) to 8), the liquid receiver has a first space which is formed above an upper end of the plug and with which the refrigerant inflow hole communicates and a second space which is formed below the upper end of the plug and with which the refrigerant outflow hole communicates; the plug has a flow passage one end of which is open to the first space and the other end of which is open to the second space; an opening of the flow passage on the first space side is located at a vertical position below the refrigerant inflow hole; and a throttle portion having a cross-sectional area smaller than a hole area of the refrigerant inflow hole is provided in the flow passage. Therefore, the refrigerant having flowed from the condensation section outlet header of the condensation section into the first space of the liquid receiver through the refrigerant inflow hole is separated into gas-phase refrigerant and liquid-phase refrigerant within the first space. The liquid-phase refrigerant flows into the second space of the liquid receiver through the flow passage of the plug. Subsequently, the liquid-phase refrigerant passes through the refrigerant outflow hole and flows into the supercooling section inlet header. Since the first-space-side opening of the flow passage of the plug is located at a vertical position below the refrigerant inflow hole, liquid-phase refrigerant of high density which is a portion of the gas-liquid-mixed-phase refrigerant having flowed into the first space of the liquid receiver through the refrigerant inflow hole becomes more likely to flow into the second space through the flow passage as compared with gas-phase refrigerant of low density. In addition, since the throttle portion whose cross-sectional area is smaller than the hole area of the refrigerant inflow hole is provided in the flow passage of the plug, as a result of the action of the throttle portion, the gas-phase refrigerant which is a portion of the gas-liquid-mixed-phase refrigerant having flowed into the first space of the liquid receiver through the refrigerant inflow hole and which is large in specific volume becomes less likely to flow through the flow passage, and the liquid-phase refrigerant which is small in specific volume becomes more likely to flow into the second space through the flow passage. Accordingly, the gas liquid separation performance of the liquid receiver is enhanced, whereby excellent cooling performance is obtained.

In addition, since the first-space-side opening of the flow passage of the plug is located at a vertical position below the refrigerant inflow hole, when refrigerant is charged into a refrigeration cycle using the condenser, the refrigerant having flowed from the condensation section outlet header into the first space through the refrigerant inflow hole flows into the supercooling section inlet header at a relatively early stage through the flow passage of the plug, the second space, and the refrigerant outflow hole. Therefore, the heat exchange tubes of the supercooling section can be filled with liquid-phase refrigerant at a relatively early stage. Accordingly, the amount of refrigerant required to reach a stable region where the degree of supercooling becomes constant can be made smaller as compared with the condenser disclosed in Japanese Patent Application Laid-Open No. 2010-185648. As a result, the amount of refrigerant to be charged can be reduced.

In the condenser of par. 2), the upper end of the plug is located at a vertical position between the refrigerant inflow hole and the refrigerant outflow hole; a seal member is provided for sealing between a portion of an outer circumferential surface of the plug, which portion is located above the refrigerant outflow hole, and a portion of an inner circumferential surface of the liquid receiver main body, which portion is located between the refrigerant inflow hole and the refrigerant outflow hole; and at a position below the seal member, the second space is formed between the outer circumferential surface of the plug and the inner circumferential surface of the liquid receiver main body. Therefore, the refrigerant having flowed from the condensation section outlet header into the first space of the liquid receiver through the refrigerant inflow hole flows into the second space through the flow passage of the plug and then flows into the supercooling section inlet header through the refrigerant outflow hole. Since the first-space-side opening of the flow passage of the plug is located at a vertical position below the refrigerant inflow hole and a throttle portion is provided in the flow passage of the plug, when refrigerant is charged into a refrigeration cycle using the condenser, the heat exchange tubes of the supercooling section can be filled with liquid-phase refrigerant at an early stage. Accordingly, the amount of refrigerant required to reach a stable region where the degree of supercooling becomes constant can be made smaller as compared with the condenser disclosed in Japanese Patent Application Laid-Open No. 2010-185648.

In the condenser of par. 3), through employment of a relatively simple structure, the flow passage one end of which is open to the first space and the other end of which is open to the second space can be formed in the plug, the throttle portion can be provided in the flow passage, and the first-space-side opening of the flow passage can be positioned at a vertical position below the refrigerant inflow hole without fail.

In the condenser of par. 4), the upper end of the circumferential wall portion of the plug is located at a vertical position between the refrigerant inflow hole and the refrigerant outflow hole; a seal member is provided for sealing between a portion of an outer circumferential surface of the circumferential wall portion of the plug located above the refrigerant outflow hole and a portion of an inner circumferential surface of the liquid receiver main body located between the refrigerant inflow hole and the refrigerant outflow hole; and at a position below the seal member, the second space is formed between the outer circumferential surface of the plug and the inner circumferential surface of the liquid receiver main body. Therefore, the refrigerant having flowed from the condensation section outlet header into the first space of the liquid receiver through the refrigerant inflow hole flows into the second space through the flow passage of the plug and then flows into the supercooling section inlet header through the refrigerant outflow hole. Since the first-space-side opening of the flow passage of the plug is located at a vertical position below the refrigerant inflow hole and a throttle portion is provided in the flow passage of the plug, when refrigerant is charged into a refrigeration cycle using the condenser, the heat exchange tubes of the supercooling section can be filled with liquid-phase refrigerant at an early stage. Accordingly, the amount of refrigerant required to reach a stable region where the degree of supercooling becomes constant can be made smaller as compared with the condenser disclosed in Japanese Patent Application Laid-Open No. 2010-185648. Also, through employment of a relatively simple structure, the flow passage one end of which is open to the first space and the other end of which is open to the second space can be formed in the plug, the throttle portion can be provided in the flow passage, and the first-space-side opening of the flow passage can be positioned at a vertical position below the refrigerant inflow hole without fail.

In the condenser of par. 5) or 6), since the refrigerant having flowed into the first space of the liquid receiver through the refrigerant inflow hole hits against the outer circumferential surface of the upward protruding portion, the flow velocity of the refrigerant can be decreased so as to suppress the influence of inertial force and increase the influence of gravitational force. Accordingly, the gas-liquid-mixed-phase refrigerant having flowed from the condensation section outlet header into the first space of the liquid receiver through the refrigerant inflow hole is efficiently separated into gas-phase refrigerant and liquid-phase refrigerant, and liquid-phase refrigerant of high density becomes more likely to flow into the second space through the flow passage as compared with gas-phase refrigerant of low density. As a result, the gas liquid separation performance is enhanced further.

What is claimed is:

1. A condenser comprising a condensation section; a supercooling section provided below the condensation section; and a liquid receiver which is provided between the condensation section and the supercooling section and which receives gas-liquid-mixed-phase refrigerant from the condensation section and separates the gas-liquid-mixed-phase refrigerant into gas-phase refrigerant and liquid-phase refrigerant, the liquid receiver including a liquid receiver main body whose longitudinal direction coincides with a vertical direction and which has a closed upper end and an open lower end, and a plug removably fitted into the liquid receiver main body from below so as to close a lower end opening of the liquid receiver main body, the liquid receiver main body having a refrigerant inflow hole into which refrigerant flows from the condensation section and a refrigerant outflow hole from which refrigerant flows into the supercooling section, the refrigerant inflow hole and the refrigerant outflow hole being formed at an interval in the vertical direction such that the refrigerant inflow hole is located above the refrigerant outflow hole, wherein the liquid receiver has a first space which is formed above an upper end of the plug and with which the refrigerant inflow hole communicates and a second space which is formed below the upper end of the plug and with which the refrigerant outflow hole communicates;

the plug has a flow passage one end of which is open to the first space and the other end of which is open to the second space;

an opening of the flow passage on a first space side is located at a vertical position below the refrigerant inflow hole; and a throttle portion having a cross-sectional area smaller than a hole area of the refrigerant inflow hole is provided in the flow passage, wherein the plug has a tubular circumferential wall portion, a partition wall portion provided on a portion of the circumferential wall portion located below the refrigerant outflow hole so as to separate a space inside the circumferential wall portion and a space outside the liquid receiver from each other, and an upward protruding portion provided on the partition wall portion; an upper end of the circumferential wall portion of the plug is located at a vertical position between the refrigerant inflow hole and the refrigerant outflow hole; a seal member is provided for sealing between a portion of an outer circumferential surface of the circumferential wall portion located above the refrigerant outflow hole and a portion of an inner circumferential surface of the liquid receiver main body located between the refrigerant inflow hole and the refrigerant outflow hole; at a position below the seal member, the second space is formed between the outer circumferential surface of the circumferential wall portion of the plug and the inner circumferential surface of the liquid receiver main body; a refrigerant flow gap which is open upward and communicates with the first space is formed between an inner circumferential surface of the circumferential wall portion of the plug and an outer circumferential surface of the upward protruding portion over an entire circumference of the inner circumferential surface of the plug and the outer circumferential surface of the upward protruding portion; the refrigerant flow gap has a constant cross-sectional area over its entirety in the vertical direction; an upper end opening of the refrigerant flow gap has an area smaller than the hole area of the refrigerant inflow hole; the circumferential wall portion of the plug has a through hole for establishing communication between the refrigerant flow gap and the second space; the flow passage is formed by the refrigerant flow gap and the through hole of the circumferential wall portion, and the refrigerant flow gap serves as the throttle portion, and wherein an upper end of the upward protruding portion is located at a vertical position above a lower end of the refrigerant inflow hole, so that refrigerant flowing into the liquid receiver through the refrigerant inflow hole hits against the outer circumferential surface of the upward protruding portion.

2. The condenser according to claim 1, wherein the upper end of the plug is located at a vertical position between the refrigerant inflow hole and the refrigerant outflow hole; a seal member is provided for sealing between a portion of an outer circumferential surface of the plug, which portion is located above the refrigerant outflow hole, and a portion of an inner circumferential surface of the liquid receiver main body, which portion is located between the refrigerant inflow hole and the refrigerant outflow hole; and at a position below the seal member, the second space is formed between the outer circumferential surface of the plug and the inner circumferential surface of the liquid receiver main body.

3. The condenser according to claim 1, wherein the upper end of the upward protruding portion is located at a vertical position which is the same as or above an upper end of the refrigerant inflow hole.

4. The condenser according to claim 1, wherein a female screw portion is provided on a portion of an inner circumferential surface of the liquid receiver main body located below the refrigerant outflow hole; a male screw portion is provided on a vertically intermediate portion of an outer circumferential surface of the plug located below the refrigerant outflow hole: the male screw portion is screwed into the female screw portion of the liquid receiver main body; and a lower seal member is provided for sealing between a portion of the inner circumferential surface of the liquid receiver main body located below the female screw portion and a portion of the outer circumferential surface of the plug located below the male screw portion.

5. The condenser according to claim 1, wherein the condensation section has a condensation section outlet header; the supercooling section has a supercooling section inlet header; the condensation section outlet header and the supercooling section inlet header are provided in a single header tank; the liquid receiver main body of the liquid receiver is composed of a tubular base member which is open at upper and lower ends thereof and is joined to the header tank, and a tubular tank member which is closed at its upper end and is open at its lower end and whose lower end portion is fixed to the base member; and the plug is fitted into the base member from below.

* * * * *